US011674212B2

(12) United States Patent
Hashimoto et al.

(10) Patent No.: US 11,674,212 B2
(45) Date of Patent: Jun. 13, 2023

(54) CAST PRODUCT HAVING ALUMINA BARRIER LAYER

(71) Applicant: KUBOTA CORPORATION, Osaka (JP)

(72) Inventors: Kunihide Hashimoto, Hirakata (JP); Shinichi Uramaru, Hirakata (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/493,298

(22) Filed: Oct. 4, 2021

(65) Prior Publication Data

US 2022/0025504 A1 Jan. 27, 2022

Related U.S. Application Data

(63) Continuation-in-part of application No. 15/116,738, filed as application No. PCT/JP2014/083417 on Dec. 17, 2014, now abandoned.

(30) Foreign Application Priority Data

Mar. 28, 2014 (JP) ..... 2014-067836

(51) Int. Cl.
*C21D 6/00* (2006.01)
*C21D 9/14* (2006.01)
(Continued)

(52) U.S. Cl.
CPC ..... *C23C 8/14* (2013.01); *C21D 6/004* (2013.01); *C21D 6/005* (2013.01); *C21D 6/008* (2013.01);
(Continued)

(58) Field of Classification Search
CPC .. C21D 6/004; C23C 8/14; C23C 8/18; C23C 8/06–38; C23C 38/06; C23C 38/40;
(Continued)

(56) References Cited

U.S. PATENT DOCUMENTS 3,811,874 A * 5/1974 Caule ..... C22C 38/00 420/72
3,817,747 A * 6/1974 Schultz et al. ..... C22C 19/053 420/446
(Continued)

FOREIGN PATENT DOCUMENTS

JP SHO 52-078612 7/1977
JP SHO 53-31517 A 3/1978
(Continued)

OTHER PUBLICATIONS

European Patent Office, "Summons to attend oral proceedings pursuant to Rule 115(1) EPC", for corresponding European Patent 3 124 645 B1, 6 pp., Mar. 17, 2021.
(Continued)

*Primary Examiner* — Michael C Romanowski
(74) *Attorney, Agent, or Firm* — Eckert Seamans Cherin & Mellott, LLC

(57) ABSTRACT

The present invention provides a cast product that can further enhance the stability of a barrier layer and can exhibit further superior oxidation resistance, carburization resistance, nitriding resistance, and corrosion resistance, when used under a high-temperature atmosphere, the cast product having a surface with a barrier layer comprising an Al-containing metal oxide expressed in $(Al_{(1-x)}M_{(x)})_2O_3$, where M is at least one of Cr, Ni, Si, and Fe, wherein the Al-containing metal oxide includes a solid solution of at least one of Cr, Ni, Si, and Fe with Al, in a relationship of Al/(Cr+Ni+Si+Fe)≥2.0 in an atomic % ratio, the barrier layer being composed of two layers consisting of a first Al-containing metal oxide layer and a second Al-containing metal oxide layer formed between the surface of the cast product and the first Al-containing metal oxide layer, and the second Al-containing metal oxide layer being greater than the first Al-containing metal oxide layer with respect to the
(Continued)

atomic % ratio of Al/(Cr+Ni+Si+Fe), and having a thickness that is at least one fifth of a thickness of the barrier layer.

10 Claims, 4 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C23C 8/14*** | (2006.01) |
| ***C23C 8/80*** | (2006.01) |
| ***C22C 38/40*** | (2006.01) |

(52) U.S. Cl.
CPC ..... *C21D 9/14* (2013.01); *C22C 38/005* (2013.01); *C22C 38/02* (2013.01); *C22C 38/04* (2013.01); *C22C 38/06* (2013.01); *C22C 38/40* (2013.01); *C22C 38/44* (2013.01); *C22C 38/48* (2013.01); *C22C 38/50* (2013.01); *C22C 38/54* (2013.01); *C23C 8/80* (2013.01)

(58) Field of Classification Search
CPC ..... C23C 38/44; C23C 38/48; C23C 38/54; C23C 37/10
See application file for complete search history.

(56) References Cited

U.S. PATENT DOCUMENTS

| | | | | |
|---|---|---|---|---|
| 4,204,862 | A | 5/1980 | Kado et al. | |
| 4,248,629 | A | 2/1981 | Pons et al. | |
| 4,266,987 | A * | 5/1981 | Wang | C23C 8/10 427/372.2 |
| 5,089,223 | A * | 2/1992 | Hamada | C22C 38/40 420/584.1 |
| 5,413,642 | A * | 5/1995 | Alger | C23C 8/02 148/272 |
| 5,531,837 | A * | 7/1996 | Ohashi | C23C 8/14 148/285 |
| 5,580,398 | A * | 12/1996 | Ohmi | C23C 8/02 148/286 |
| 5,789,086 | A * | 8/1998 | Ohmi | C23C 8/14 428/472 |
| 5,916,378 | A * | 6/1999 | Bailey | C23C 16/4404 438/909 |
| 5,951,787 | A * | 9/1999 | Ohmi | C23C 8/02 420/34 |
| 5,981,089 | A * | 11/1999 | Imai | C23C 26/00 428/668 |
| 6,410,153 | B1 * | 6/2002 | Broomfield | C22C 19/057 420/460 |
| 6,458,318 | B1 * | 10/2002 | Nishiyama | C22C 19/055 420/447 |
| 6,612,898 | B1 * | 9/2003 | Ohmi | C23C 8/16 428/629 |
| 2005/0276990 | A1 * | 12/2005 | Kohara | C23C 28/341 427/532 |
| 2006/0191600 | A1 | 8/2006 | Omura et al. | |
| 2006/0257675 | A1 * | 11/2006 | Chun | C23C 4/02 252/500 |
| 2006/0263640 | A1 * | 11/2006 | Tamagaki | C23C 14/081 427/248.1 |
| 2008/0163957 | A1 | 7/2008 | Brady et al. | |
| 2008/0292489 | A1 * | 11/2008 | Yamamoto | C22C 38/06 420/47 |
| 2009/0314390 | A1 | 12/2009 | Gigliotti et al. | |
| 2010/0015564 | A1 * | 1/2010 | Chun | C23C 28/322 138/143 |
| 2011/0272070 | A1 * | 11/2011 | Jakobi | C22C 19/05 420/586 |
| 2011/0318593 | A1 | 12/2011 | Takahashi et al. | |
| 2014/0205802 | A1 | 7/2014 | Enjo et al. | |
| 2015/0322560 | A1 * | 11/2015 | Masaki | C22F 1/00 428/332 |
| 2016/0010850 | A1 | 1/2016 | Hammon et al. | |
| 2016/0035469 | A1 * | 2/2016 | Yamazaki | C21D 9/46 148/112 |
| 2016/0160328 | A1 * | 6/2016 | Mizutani | C22C 38/48 428/606 |

FOREIGN PATENT DOCUMENTS

| | | | |
|---|---|---|---|
| JP | SHO 54-125118 | A | 9/1979 |
| JP | 56-041364 | A | 1/1981 |
| JP | SHO 57-39159 | A | 3/1982 |
| JP | HEI 05-195138 | A | 8/1993 |
| JP | 2007-119802 | A | 5/2007 |
| JP | 2013-199672 | A | 10/2013 |
| JP | 2013-227655 | A | 11/2013 |
| JP | 2014-501620 | A | 1/2014 |
| WO | 2004111291 | A1 | 12/2004 |
| WO | 2010043375 | A1 | 4/2010 |
| WO | 2010113830 | A1 | 10/2010 |
| WO | 2012/054377 | A1 | 4/2012 |

OTHER PUBLICATIONS

Vorburger TB et al Comparison of Optical and Stylus Methods for Measurement of Surface Texture: (Published online on Feb. 7, 2007), 9 pp.

European Patent Office, "Statement of Opposition", opposition filed against European Patent 3124645 B1 (patent in dispute), 67 pp., (English language translation also attached, 58 pp.), Jul. 29, 2020.

Japanese Patent Office, "Office Action" from counterpart JP Application No. 2017-222899 (no English language translation available), 4 pp., dated Feb. 5, 2019.

European Patent Office, "extended European Search Report", from counterpart EP Application No. 14 887 198.1, 10 pp., dated Oct. 4, 2017.

Ota et al., "Effect of adding Al, Zr, Y, Ce La, Hf on carburization resistance of high Si 25Cr—35Ni Steel" (in Japanese), The Iron and Steel Institute of Japan (ISIJ), vol. 67 No. 13, Sep. 10, 1981 S1266, 1 page.

Japanese Patent Office, "International Search Report", PCT/JP2014/083417, Jan. 21, 2015 (completion date); dated Feb. 3, 2015, 5 pp.

The International Bureau of WIPO, "English translation of International Preliminary Report on Patentability", PCT/JP2014/083417, dated Oct. 4, 2016, 5 pp.

Sschmidt+Clemens "Investigation Report", Report No. Z 552, dated Dec. 22, 2022, 8 pp.

S. Wang et al., Corrosion Science, "The effect of Si additions on the high temperature oxidation of a ternary Ni—10Cr—4Al alloy in 1 atm 02 at 1100° C.", Journal homepage: www.elsevier.com/locate/corsci, Available online: Nov. 6, 2008, 7 pp.

H.-E. Zschau et al., 2nd Advanced Optical Metrology Compendium, Materials and Corrosion 2011, 62, No. 7, "Oxidation protection of Ni-base superalloys by halogen treatment", www.matcorr.com, wileyonlinelibrary.com, 9 pp.

J. Hall et al., Original Paper, "The Initial Oxide Scale Development on a Model FeNiCrAl Alloy at 900° C. in Dry and Humid Atmosphere: A Detailed Investigation", Article in Oxidation of Metals—Oct. 2014, 24 pp.

European Patent Office Official Communication "Letter of the Opponent", issued Jan. 4, 2023, for corresponding EP Patent No. 3 124 645, 82 pp.

* cited by examiner

SEM

| ELEMENT | (keV) | Mass% | Error% | Atomic% | K |
|---|---|---|---|---|---|
| O K | 0.525 | 24.43 | 0.10 | 51.82 | 32.7805 |
| Al K | 1.486 | 0.44 | 0.19 | 0.58 | 0.2401 |
| Cr K | 5.411 | 47.71 | 0.73 | 31.14 | 43.5803 |
| Mn K | 5.894 | 2.63 | 0.84 | 1.62 | 2.3122 |
| Fe K | 6.398 | 17.60 | 1.09 | 10.72 | 15.0173 |
| Ni K | 7.471 | 7.13 | 1.94 | 4.12 | 6.1016 |
| Total | | 100.00 | | 100.00 | |

EDX

CAST PRODUCT HAVING ALUMINA BARRIER LAYER

CROSS-REFERENCE TO RELATED APPLICATIONS

This application is a continuation in part of U.S. patent application Ser. No. 15/116,738, having a filing date of Aug. 4, 2016, entitled CAST PRODUCT HAVING ALUMINA BARRIER LAYER, which claims the benefit of PCT/JP2014/083417 having an international filing date of Dec. 17, 2014, which claimed a priority of Japanese Patent Application No. 2014-067836 that was filed on Mar. 28, 2014, the contents of which are incorporated herein by reference.

BACKGROUND OF THE INVENTION

Field of the Invention

The present invention relates to a cast product having a barrier layer of an aluminum-containing metal oxide with a stable structure.

Description of the Related Art

Heat-resistant steel castings such as reaction tubes and decomposition tubes for producing ethylene, and hearth rolls, radiant tubes and metal dusting-resistant materials for use in carburizing heat-treatment furnaces are exposed to a high temperature atmosphere, and therefore are made of an austenite-based heat-resistant alloy having superior high-temperature strength.

A metal oxide layer is formed on the surface of this type of austenite-based heat-resistant alloy during use in a high temperature atmosphere. This oxide layer serves as a barrier, and thus protects the base material under a high-temperature atmosphere.

On the other hand, when Cr-oxides (mainly constituted by $Cr_2O_3$) are formed as the metal oxide, the Cr-oxide layer is insufficient in preventing the entry of oxygen and carbon due to its low denseness, thus causing the internal oxidation under a high-temperature atmosphere and the thickening of the oxide layer. Moreover, the Cr-oxide layer is likely to become detached during repeated cycles of heating and cooling. Even if the Cr-oxide layer does not become detached, the Cr-oxide layer has an insufficient function for preventing the entry of oxygen and carbon from an outside atmosphere, and therefore, there is a disadvantageous situation in which oxygen and carbon pass through the layer and cause the internal oxidation or carburization of the base material.

To address this issue, it has been proposed that an oxide layer including alumina ($Al_2O_3$) as a main component that has high denseness and makes it difficult for oxygen and carbon to pass therethrough is formed on the surface of the base material by increasing the content of Al compared with that in a common austenite-based heat-resistant alloy (see Patent Documents 1 and 2, for example).

However, Al is a ferrite-forming element, and therefore, when the content of Al is increased, the ductility of the materials is deteriorated and the high-temperature strength is reduced. This tendency of reduction of the ductility is observed particularly when the content of Al exceeds 5%.

The austenite-based heat-resistant alloy of Patent Documents 1 and 2 can be expected to have an enhanced barrier function due to $Al_2O_3$, but has the disadvantage of causing a reduction of the ductility of the base material.

Patent Document 3 has proposed to provide a cast product that can secure the high-temperature stability of $Al_2O_3$ and can achieve a superior barrier function under a high-temperature atmosphere without reducing the ductility of the materials. Patent Document 3 discloses a cast product in which a barrier layer including $Al_2O_3$ is formed on the inner surface of a cast body and Cr-based particles that contain Cr at a higher concentration than that of a matrix of the base material are dispersed at an interface between the barrier layer and the cast body by performing heat treatment under an oxidizing atmosphere after processing the inner surface such that a surface roughness (Ra) of the cast body is 0.05 to 2.5 μm.

Owing to the presence of a stable barrier layer, superior oxidation resistance, carburization resistance, nitriding resistance, corrosion resistance, etc. of the cast product of Patent document 3 can be maintained for a long period of time of use under a high-temperature atmosphere.

Patent Document 4 discloses that a steam-cracker tube is formed on an inner surface thereof with a protective oxide layer by the heat treatment for conditioning under an extremely weakly oxidizing inert gas at 400-750° C. followed by an operating temperature of 800-900° C. The protective layer essentially consists of $Al_2O_2$ and to a small degree of $(Al, Cr)_2O_3$. When the steam-cracker tube is subjected to the cracking operation, the temperature of the tube increases and reaches 1000° C. and even 1050° C. as a result of the deposition of pyrolytic coke, and the aluminum oxide formed during the conditioning process is converted from a transitional oxide such as γ-, δ- or θ-$Al_2O_2$ into stable α-aluminum oxide during the cracking operation process.

PRIOR ART DOCUMENTS

Patent Documents

Patent Document 1: JP S52-78612A
Patent Document 2: JP S57-39159A
Patent Document 3: WO 2010/113830
Patent Document 4: US2011/0272070 A1

SUMMARY OF THE INVENTION

It is an object of the present invention to provide a cast product that can further enhance the stability of the barrier layer and can exhibit further superior oxidation resistance, carburization resistance, nitriding resistance, corrosion resistance, and the like when used under a high-temperature atmosphere.

The present invention is to provide a cast product having a barrier layer formed on a surface of the cast product, the barrier layer comprising an Al-containing metal oxide expressed in $(Al_{(1-x)}M_{(x)})_2O_3$, where M is at least one of Cr, Ni, Si, and Fe, wherein the Al-containing metal oxide includes a solid solution of at least one of Cr, Ni, Si, and Fe with Al, in a relationship of Al/(Cr+Ni+Si+Fe)≥2.0 in an atomic % ratio, the barrier layer being composed of two layers consisting of a first Al-containing metal oxide layer and a second Al-containing metal oxide layer between the surface of the cast product and the first Al-containing metal oxide layer, wherein the second Al-containing metal oxide layer is greater than the first Al-containing metal oxide layer with respect to the atomic % ratio of Al/(Cr+Ni+Si+Fe), and the second Al-containing metal oxide layer has a thickness that is at least one fifth of a thickness of the barrier layer.

The Al-containing metal oxide of the cast product has a crystal structure and at least 80 vol. % thereof is corundum structure.

The solid solution includes Cr with Al, in a relationship of Al/Cr≥10 in an atomic % ratio.

The solid solution includes one of Ni, Si, and Fe with Al, the at least one of Ni, Si, and Fe having a total amount of up to 10 atomic %.

The barrier layer of the cast product has a surface roughness (Ra) of 15 μm or less.

The cast product is made of a heat-resistant alloy consisting essentially of, in terms of mass %, C in an amount of 0.05 to 0.7%, Si in an amount of more than 0% to 2.5%, Mn in an amount of more than 0% to 3.0%, Cr in an amount of 15.0 to 50.0%, Ni in an amount of 18.0 to 70.0%, Al in an amount of 1.0 to 5.0%, rare earth elements in an amount of 0.005 to 0.4%, at least one of W in an amount of 0.5 to 10.0% and Mo in an amount of 0.1 to 5.0%, the balance being Fe and inevitable impurities.

The heat-resistant alloy further contains, in terms of mass %, at least one selected from the group consisting of Ti in an amount of 0.01 to 0.6%, Zr in an amount of 0.01 to 0.6%, and Nb in an amount of 0.1 to 1.8%.

The heat-resistant alloy further contains, in terms of mass %, B in an amount of more than 0% to 0.1%.

A reaction tube made of the cast product as mentioned above is configured to produce ethylene by passing hydrocarbon feedstock gas along the tube inner surface of the tube, the inner surface of the tube has the barrier layer comprising the Al-containing metal oxide.

Effects of the Invention

According to the cast product of the present invention, the barrier layer is composed of two layers consisting of a first Al-containing metal oxide layer and a second Al-containing metal oxide layer, wherein a concentration of Al in the second Al-containing metal oxide layer formed between the first Al-containing metal oxide layer and a surface of the cast product is higher than that of the first Al-containing metal oxide layer, so that the second Al-containing metal oxide layer has a function to inhibit the coupling with oxygen and the formation of oxides containing Cr, Ni, Si, and Fe as the main component on the surface of the product, during operation at an elevated temperature. And the first and second Al-containing metal oxide layers have a stabilized crystal structure comprising corundum structure.

This makes the cast product of the present invention to exhibit further superior oxidation resistance, carburization resistance, nitriding resistance, and corrosion resistance, when used under a high-temperature atmosphere, as compared to the cast product of Patent document 3.

Therefore, the cast product of the present invention, when used for a reaction tube for producing ethylene, inhibits the occurrence of coking, whereby the heat exchange rate and thermal conductivity of the tube are kept to decrease the loss of yield and prolong a continuous operation period of time. In addition, since coking is hardly to occur, the frequency and time required for coke-removing operation can be decreased to enhance operation efficiency.

DESCRIPTION OF THE PREFERRED EMBODIMENTS

Figure 1:
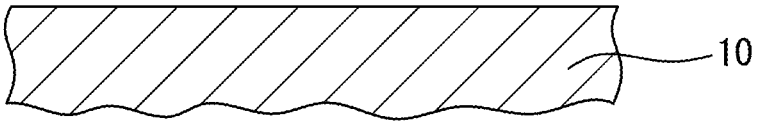
FIG. 1 is a cross-sectional view of a cast product before heat treatment.

Embodiments of the present invention will be described below in detail.

A cast product of the present invention is formed on a surface thereof with a barrier layer comprising Al-containing metal oxides.

The Al-containing metal oxides in the barrier layer is $(Al_{(1-x)}M_{(x)})_2O_3$, where M is at least one of Cr, Ni, Si, and Fe, and x is preferred to satisfy the relationship $0<x<0.5$.

The Al-containing metal oxides of the barrier layer comprises a solid solution of at least one of Cr, Ni, Si, and Fe with Al, in relationship Al/(Cr+Ni+Si+Fe)≥2.0 in an atomic % ratio.

<Explanation of Reasons for Limiting Components>

The advantageous effects can be achieved if the cast product of the present invention is made of a heat-resistant alloy comprising Cr in an amount of 15 mass % or more, Ni in an amount of 18 mass % or more, and Al in an amount of 1 to 5 mass %. The cast product of the present invention is made of a heat-resistant alloy having following components, for example. It should be noted that in the following description, the term "%" refers to as "mass %," unless otherwise stated.

C: 0.05 to 0.7%

C acts to improve castability and enhance a high-temperature creep rupture strength. Therefore, the content of C is set to at least 0.05%. However, if the content is too large, a primary carbide of $Cr_7C_3$ is likely to be extensively formed and the movement of Al for forming the barrier layer is inhibited. As a result, Al to be supplied to the surface portion of a cast product is insufficient and the barrier layer is locally divided, and thus the continuity of the barrier layer is impaired. Moreover, a secondary carbide excessively deposits to reduce ductility and toughness. Therefore, the upper limit is set to 0.7%. It should be noted that the content of C is more desirably 0.3 to 0.5%.

Si: more than 0% to 2.5% or less

Si is contained to serve as a deoxidizer for molten alloy and to enhance the fluidity of molten alloy. If the content is too large, a high-temperature creep rupture strength is reduced, and therefore, the upper limit is set to 2.5%. It should be noted that the content of Si is more desirably 2.0% or less.

Mn: more than 0% to 3.0% or less

Mn is contained to serve as a deoxidizer for molten alloy and to fix S in molten alloy. If the content is too large, high-temperature creep rupture strength is reduced, and therefore, the upper limit is set to 3.0%. It should be noted that the content of Mn is more desirably 1.6% or less.

Cr: 15.0 to 50.0%

Cr is contained in an amount of 15.0% or more in order to contribute to the enhancement of high-temperature strength and cyclic oxidation resistance. However, if the content is too large, high-temperature creep rupture strength is reduced, and therefore, the upper limit is set to 50.0%. It should be noted that the content of Cr is more desirably 23.0 to 35.0%.

Ni: 18.0 to 70.0%

Ni is an element that is necessary to secure cyclic oxidation resistance and the stability of a metal structure. If the content of Ni is small, the content of Fe relatively becomes large. As a result, a Cr—Fe—Mn oxide is likely to be formed on the surface of the cast product, and thus the formation of the barrier layer is inhibited. Therefore, the content of Ni is set to at least 18.0%. Even if the content of Ni exceeds 70.0%, it is impossible to obtain the efficacy corresponding to the increasing amount, and therefore, the upper limit is set to 70.0%. It should be noted that the content of Ni is more desirably 28.0 to 45.0%.

Al: 1.0 to 5.0%

Al is an element that is effective for enhancing carburization resistance and coking resistance. Also, in the present invention, Al is an element that is essential for forming the barrier layer on the surface of the cast product. Therefore, the content of Al is set to at least 1.0%. However, if the content of Al exceeds 5%, the ductility is deteriorated, and therefore, the upper limit is set to 5.0% in the present invention. It should be noted that the content of Al is more desirably 2.5 to 3.8%.

Rare earth elements: 0.005 to 0.4%

The term "rare earth elements" means 17 elements including 15 elements of the lanthanide series ranging from La to Lu in the periodic table, and Y and Sc. It is preferable that rare earth elements to be contained in the heat-resistant alloy of the present invention include at least one element selected from the group consisting of Ce, La and Nd. Rare earth elements contribute to the formation of the barrier layer and the enhancement of stability thereof.

When the barrier layer is formed by heat treatment under a high-temperature oxidizing atmosphere, rare earth elements that are contained in an amount of 0.005% or more effectively contribute to the formation of the barrier layer.

On the other hand, if the content is too large, the ductility and toughness are deteriorated, and therefore, the upper limit is set to 0.4%.

W: 0.5 to 10.0% and/or Mo: 0.1 to 5.0%

W and Mo enhance creep rupture strength by forming a solid solution in a matrix and strengthening an austenite phase. At least one of W and Mo is contained in order to achieve this efficacy. The content of W is set to 0.5% or more, and the content of Mo is set to 0.1% or more.

However, if the contents of W and Mo are too large, ductility is reduced and carburization resistance is deteriorated. Moreover, as in the case where the content of C is large, a primary carbide of $(Cr, W, Mo)_7C_3$ is likely to be extensively formed and the movement of Al for forming the barrier layer is inhibited. As a result, Al is insufficiently supplied to the surface portion of the cast product and the barrier layer is locally divided, and thus the continuity of the barrier layer is likely to be impaired. Furthermore, since W and Mo have a large atomic radius, they inhibit the movement of Al and Cr and prevent the formation of the barrier layer due to the formation of a solid solution in the matrix.

Therefore, the content of W is set to 10.0% or less, and the content of Mo is set to 5.0% or less. It should be noted that when both elements are contained, the total content is preferably set to 10.0% or less.

In addition, the following components may be contained.

At least one selected from the group consisting of Ti in an amount of 0.01 to 0.6%, Zr in an amount of 0.01 to 0.6%, and Nb in an amount of 0.1 to 1.8%

Ti, Zr and Nb are elements that are likely to form carbides, and form less solid solutions in the matrix than W and Mo. Therefore, Ti, Zr and Nb do not exhibit any particular action of forming the barrier layer, but enhance creep rupture strength. At least one of Ti, Zr and Nb can be contained as needed. The content of Ti or Zr is set to 0.01% or more and the content of Nb is set to 0.1% or more.

However, if they are excessively added, ductility is reduced. Furthermore, Nb reduces the peeling resistance of the barrier layer. Therefore, the upper limit of the content of Ti or Zr is set to 0.6%, and the upper limit of the content of Nb is set to 1.8%.

B: more than 0% to 0.1% or less

Since B exhibits an action of strengthening the particle boundaries of a matrix of the cast product, B can be contained as needed. It should be noted that if the content of B is large, creep rupture strength is reduced, and therefore, the content of B is set to 0.1% or less even in the case where B is added.

The heat-resistant alloy making up the cast product of the present invention includes the above-described components and Fe as the balance. P, S, and other impurities that are inevitably mixed in the alloy when melting the alloy may be contained as long as such impurities are contained in an amount within a range that is usually allowable to this type of alloy material.

<Cast Product>

Molten metal having a composition including the above-described components is cast by centrifugal casting, static casting, or the like into the cast product of the present invention having the above composition.

The obtained cast product can be shaped depending on the intended application.

One example of the cast product is a tube, in particular, a reaction tube used under a high-temperature environment.

It is particularly preferable to produce the cast product of the present invention by centrifugal casting. For the centrifugal casting, a fine metal structure grown in the radial direction with orientation due to the progress of cooling by a metal mold is obtained, and a lightweight aluminum is moved toward the inside surface of the cast product.

Heat treatment is performed on the cast product, which will be described later. The barrier layer having a stable phase structure is formed by the heat treatment.

<Heat Treatment>

The cast product of the present invention is subjected to a heat treatment under an oxidizing atmosphere. In this text, the term "oxidizing atmosphere" means an environment of air atmosphere that comprises about 21 volume % of oxygen and about 78 volume % of nitrogen, unless otherwise specified. The heat treatment comprises a first stage heat treatment at a temperature lower than 1050° C. and a second stage heat treatment at a temperature of 1050° C. or higher. The first stage heat treatment and the second stage heat treatment may be performed in separate steps or the second stage heat treatment may be performed subsequently to the first stage heat treatment.

<First Stage Heat Treatment>

The first stage heat treatment is to form a layer of a first Al-containing metal oxide on a surface of the cast product under an oxidizing atmosphere, i.e., air atmosphere. The first stage heat treatment is conducted at a temperature lower than 1050° C., preferably at 600 to 900° C. It is desirable to perform the first stage heat treatment for 5 to 15 hours.

Figure 2:
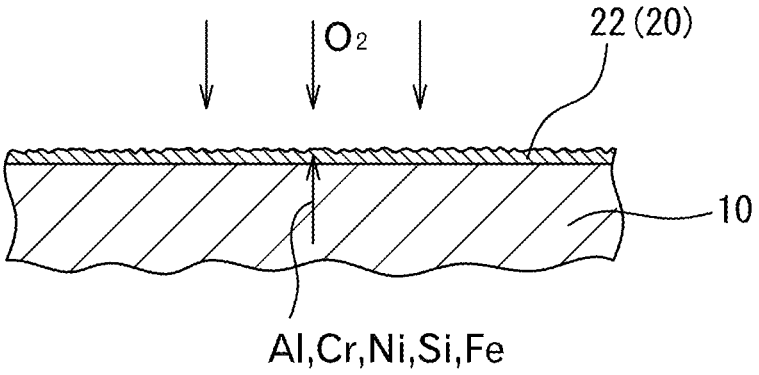
FIG. 2 is a schematic cross-sectional view illustrating a state where a first Al-containing metal oxide layer is formed by a first stage heat treatment.

During the process of the first stage heat treatment under air atmosphere, oxygen comes into contact with a surface of the product 10 as shown in FIG. 1 to thereby oxidize Al, Cr, Ni, Si, and Fe that was diffused from a matrix of the product 10 to the surface of the product, so that a layer 22 of a first Al-containing metal oxide is formed as shown in FIG. 2. In this heat treatment, Al forms oxides in preference over Cr, Ni, Si, and Fe. Accordingly, the layer 22 of the first Al-containing metal oxide comprises a solid solution of Al as a main component and at least one of Cr, Ni, Si, and Fe, which was diffused from the matrix of the product 10.

In the first Al-containing metal oxide formed by the first stage heat treatment, the element Al and the elements of at least one of Cr, Ni, Si, and Fe have a relationship Al/(Cr+Ni+Si+Fe)≥2.0 in an atomic % ratio. The composition of the Al-containing metal oxide is expressed by $(Al_{(1-x)}M_{(x)})_2O_3$, where M is at least one of Cr, Ni, Si, and Fe, and the range of x is preferably $0<x<0.5$. The aluminum solution may comprise at least Cr, in a relationship of Al/Cr≥10 in atomic % ratio, and more preferably in a relationship of Al/Cr≥15. The first Al-containing metal oxide may also comprise a solid solution of at least one of Ni, Si, and Fe with Al. A total amount of at least one of Ni, Si, and Fe may be up to 10 atomic %.

The first Al-containing metal oxide formed by the above-described first stage heat treatment has a metastable structure of gamma (γ) or theta (θ) phase, which is a porous structure. Accordingly, the first Al-containing metal oxide is not sufficient in strength.

<Second Stage Heat Treatment>

The second stage heat treatment is conducted at a higher temperature of at least 1050° C. under an air atmosphere after the first stage heat treatment. During the process of the second stage heat treatment, the first Al-containing metal oxide formed by the first stage heat treatment undergoes phase transformation to an alpha (α) phase (corundum structure) alumina structure, and a layer 24 (FIG. 3) of a second Al-containing metal oxide is formed between the surface of the cast product and the first Al-containing metal oxide.

The second stage heat treatment may be conducted for 3 to 15 hours.

Figure 3:
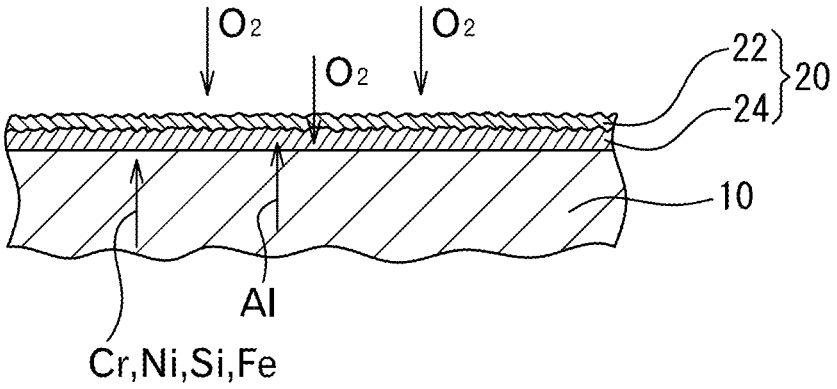
FIG. 3 is a schematic cross-sectional view illustrating a state where a second Al-containing metal oxide layer is formed between the first Al-containing metal oxide layer formed by the first stage heat treatment and a surface of the cast product, after a second stage heat treatment.

During the process of the second stage heat treatment, the γ or θ phase of the first Al-containing metal oxide that was formed during the first stage heat treatment is transformed to a stable α phase (corundum structure). And oxygen in the air atmosphere passes through the porous layer 22 of the first Al-containing metal oxide, as shown in FIG. 3.

Oxygen that passed through layer 22 of the first Al-containing metal oxide combines with Al that was diffused from the matrix of the cast product, thus forming a layer 24 of a second Al-containing metal oxide between the first Al-containing metal oxide layer 22 and the surface of the cast product.

A concentration of the second Al-containing metal oxide is higher than that of the first Al-containing metal oxide layer, which will be explained below.

To simplify the description below, "first Al-containing metal oxide" is referred to as "first oxide layer" and "second Al-containing metal oxide" is referred to as "second oxide layer."

At a high temperature of at least 1050° C., the diffusion of the components such as Al, Cr, Ni, Si, and Fe contained in the matrix toward the surface of the cast product 10 is facilitated as shown in FIG. 3. In this regard, Al is smaller than Cr, Ni, Si, and Fe with respect to an energy to bind with an oxygen. Therefore, Al combines with oxygen in preference over Cr, Ni, Si, and Fe, so that Al in the second oxide becomes concentrated.

The second oxide layer 24 is formed by the second stage heat treatment, and thus has a stable structure of a phase (corundum structure). The Al-containing metal oxides of the first oxide layer 22 and the second oxide layer 24 preferably have such a crystal structure that at least 80 vol. % is an a phase structure (corundum structure).

Since the first oxide layer 22 and the second oxide layer 24 formed between the surface of the cast product 10 and the first oxide layer 22 are both stable structures of a phase (corundum structure), the barrier layer 20 has high denseness, serves as a barrier for preventing oxygen, carbon and nitrogen from entering the matrix of the cast product from outside during use under a high-temperature atmosphere, and can maintain superior oxidation resistance, carburization resistance, nitriding resistance, corrosion resistance, and the like, for a long period of time.

The first oxide layer 22 has a thickness of, for example, 0.04 to 8.0 μm and the second oxide layer 24 has a thickness of, for example, 0.01 to 2.0 μm. Preferably, the thickness of the second oxide layer 24 is larger than that of the first oxide layer 22.

It is preferable to form the second oxide layer 24 such that the thickness of the second oxide layer 24 is at least one fifth (⅕) of that of the entire barrier layer 20.

In the above-described first and second stage heat treatments under air atmosphere condition, the heating of the cast product is preferably conducted while rotating it. This ensures that the cast product is heated uniformly and brought into contact with oxygen in better condition. As a result, the surface roughness (Ra) of the formed barrier layer 20 can be reduced.

<Surface Treatment>

Surface treatment on the barrier layer of the cast product may be performed depending on circumstances. One example of the surface treatment is polishing. For example, when the cast product is used as a reaction tube, the components such as Fe, Ni and the like of the cast product come into contact with a feedstock hydrocarbon material and coke (carbon) is likely to deposit on the inner surface of the tube due to the catalytic action of Fe and Ni. But the deposition of coke can be decreased by performing the surface treatment to lower the surface roughness (Ra) of the barrier layer.

The surface treatment is preferably performed such that the surface roughness (Ra) of the barrier layer is 15 μm or less. More preferably, the surface roughness (Ra) is 0.05 to 10 μm.

Example 1

Molten metal was produced by atmospheric melting in a high-frequency induction melting furnace and then cast into sample tubes (Inventive Examples 1-8 and Comparative Examples 1-7) by metal mold centrifugal casting. Each of the sample tubes has an inner diameter of 80 mm, an outer diameter of 100 mm, and a length of 250 mm. The chemical composition of the sample tubes are shown in Table 1. The composition of Comparative Example 7 is the same as that of Inventive Example 1.

TABLE 1

| No. | Alloy chemical composition (the balance being Fe and inevitable impurities) (mass %) | | | | | | | | | | | | |
|---|---|---|---|---|---|---|---|---|---|---|---|---|---|
| | C | Si | Mn | Cr | Ni | Al | REM | W | Mo | Ti | Zr | Nb | B |
| Inv. Ex. 1 | 0.33 | 0.49 | 0.32 | 24.5 | 43.6 | 1.2 | 0.25 | 2.1 | | 0.6 | | 0.7 | |
| Inv. Ex. 2 | 0.45 | 0.49 | 0.9 | 24.3 | 34.6 | 1 | 0.16 | | 1.5 | 0.13 | | | |
| Inv. Ex. 3 | 0.4 | 0.33 | 0.7 | 23.8 | 31.5 | 3.3 | 0.26 | | 2.8 | | | | 0.03 |
| Inv. Ex. 4 | 0.46 | 1.5 | 1.2 | 25.2 | 35 | 2.8 | 0.21 | 4.2 | | 0.09 | 0.12 | | |
| Inv. Ex. 5 | 0.26 | 0.41 | 0.5 | 23.5 | 34.6 | 3.1 | 0.07 | 0.9 | | | | | 0.07 |
| Inv. Ex. 6 | 0.31 | 0.4 | 0.2 | 18.3 | 67.1 | 4.7 | 0.01 | | 0.4 | | | 1.6 | |
| Inv. Ex. 7 | 0.38 | 0.26 | 0.4 | 23.8 | 34.4 | 4.9 | 0.11 | 0.95 | | | | 0.1 | |
| Inv. Ex. 8 | 0.67 | 1.5 | 1.1 | 23.9 | 40.1 | 4.9 | 0.19 | | 2.9 | 0.03 | | | |
| Comp. Ex. 1 | 0.33 | 1.78 | 0.17 | 25 | 33.4 | 0 | 0.11 | 0.83 | | 0.12 | | | |
| Comp. Ex. 2 | 0.4 | 1.3 | 0.9 | 25.4 | 15 | 0.9 | 0.29 | 2.9 | | | | | |
| Comp. Ex. 3 | 0.27 | 1.02 | 0.2 | 23.8 | 33.6 | 1.1 | 0.19 | 11.7 | | | | | |
| Comp. Ex. 4 | 0.34 | 0.6 | 0.2 | 25 | 45.4 | 2.9 | 0.09 | | 1.5 | | | 1.3 | |
| Comp. Ex. 5 | 0.45 | 1.43 | 1.3 | 22.9 | 34.7 | 3.2 | 0.24 | 3.15 | | 0.23 | | | |
| Comp. Ex. 6 | 0.45 | 0.54 | 0.7 | 23.8 | 29.7 | 5.1 | 0.15 | 1.5 | | 0.21 | | | |
| Comp. Ex. 7 | 0.33 | 0.49 | 0.32 | 24.5 | 43.6 | 1.2 | 0.25 | 2.1 | | 0.6 | | 0.7 | |

Inventive Examples 1-8 and Comparative Examples 1-7 were subjected to two steps of heat treatment, i.e., first stage heat treatment and second stage heat treatment.

Inventive Examples 1-8 and Comparative Examples 1-6 were heated under an air atmosphere (oxygen about 21 vol. % and nitrogen about 78 vol. %). Temperatures heated at the first and second stage heat treatments are described in Table 2. The first stage heat treatment was conducted for 5 hours, and then the second stage heat treatment was conducted for 5 hours.

Comparative Example 7 was heated under a water-vapor atmosphere (water-vapor 60 mole % and nitrogen 40 mole %), at 400° C. for 5 hours as the first stage heat treatment and then at 950° C. for 5 hours as the second stage heat treatment.

TABLE 2

| No. | First stage heat treatment temperature (° C.) | Second stage heat treatment temperature (° C.) | Oxdizing Atomosphere |
|---|---|---|---|
| Inv. Ex. 1 | 700 | 1050 | Air (21 vol. % O2 and 78 vol. % N2) |
| Inv. Ex. 2 | 900 | 1100 | Air (21 vol. % O2 and 78 vol. % N2) |
| Inv. Ex. 3 | 800 | 1050 | Air (21 vol. % O2 and 78 vol. % N2) |
| Inv. Ex. 4 | 800 | 1100 | Air (21 vol. % O2 and 78 vol. % N2) |
| Inv. Ex. 5 | 900 | 1100 | Air (21 vol. % O2 and 78 vol. % N2) |
| Inv. Ex. 6 | 600 | 1050 | Air (21 vol. % O2 and 78 vol. % N2) |
| Inv. Ex. 7 | 700 | 1100 | Air (21 vol. % O2 and 78 vol. % N2) |
| Inv. Ex. 8 | 600 | 1150 | Air (21 vol. % O2 and 78 vol. % N2) |
| Comp. Ex. 1 | 800 | 900 | Air (21 vol. % O2 and 78 vol. % N2) |
| Comp. Ex. 2 | 1000 | 1250 | Air (21 vol. % O2 and 78 vol. % N2) |
| Comp. Ex. 3 | 1200 | 1300 | Air (21 vol. % O2 and 78 vol. % N2) |
| Comp. Ex. 4 | 500 | 1150 | Air (21 vol. % O2 and 78 vol. % N2) |
| Comp. Ex. 5 | 900 | 1000 | Air (21 vol. % O2 and 78 vol. % N2) |
| Comp. Ex. 6 | 600 | 800 | Air (21 vol. % O2 and 78 vol. % N2) |
| Comp. Ex. 7 | 400 | 950 | 60 mole % water vapor and 40 mole % N2 |

After heat treatment of the sample tubes of Inventive Examples 1-8 and Comparative Examples 1-7, atomic percentages of elements (Al, Cr, Fe, Ni, Si, O) contained in the barrier layer formed on the surface of the sample tube were measured by an EDX analysis (Energy Dispersive X-ray spectrometry). Table 3 shows the results of measurements.

TABLE 3

| No. | Al (atm %) | Cr (atm %) | Fe (atm %) | Ni (atm %) | Si (atm %) | O (atm %) | Cr + Fe + Ni + Si (atm %) | Al/ (Cr + Fe + Ni + Si) | Al/Cr | Fe + Ni + Si (atm %) | Second oxide layer thickness/ Barrier layer thickness |
|---|---|---|---|---|---|---|---|---|---|---|---|
| Inv. Ex. 1 | 41.66 | 2.7 | 4.46 | 3.52 | | 48.56 | 10.7 | 3.9 | 15.43 | 7.98 | 0.5 |
| Inv. Ex. 2 | 39.2 | 3.6 | 1.4 | 3.2 | | 52.6 | 8.2 | 4.8 | 10.89 | 4.6 | 0.3 |
| Inv. Ex. 3 | 46.6 | 0.1 | 0.1 | | | 53.2 | 0.2 | 233 | 466 | 0.1 | 0.8 |
| Inv. Ex. 4 | 40.96 | 2.23 | 2.34 | 2.12 | | 52.35 | 6.7 | 6.1 | 18.37 | 4.46 | 0.6 |
| Inv. Ex. 5 | 38.4 | 1.5 | 10.1 | 6.4 | 1.2 | 42.4 | 19.2 | 2 | 25.6 | 17.7 | 0.4 |
| Inv. Ex. 6 | 42.49 | 1.31 | 2.13 | 1.95 | | 52.12 | 5.4 | 7.9 | 32.44 | 4.08 | 0.75 |
| Inv. Ex. 7 | 42.69 | 1.28 | | | | 55.93 | 1.3 | 33.4 | 33.35 | 0 | 0.7 |
| Inv. Ex. 8 | 41.8 | 2.4 | 3.9 | 6.5 | | 45.4 | 12.8 | 3.3 | 17.42 | 10.4 | 0.5 |
| Comp. Ex. 1 | | 4.61 | 10.25 | 7.09 | 31 | 47.05 | 53 | 0 | 0 | 48.34 | 0 |
| Comp. Ex. 2 | 11.17 | 15.25 | 30.1 | 25.28 | 1.47 | 16.73 | 72.1 | 0.2 | 0.73 | 56.85 | 0.1 |
| Comp. Ex. 3 | 6.7 | 35.46 | 1.65 | 1.8 | 1.64 | 52.75 | 40.6 | 0.2 | 0.19 | 5.09 | 0.05 |
| Comp. Ex. 4 | 36.7 | 6.7 | 1.8 | 10.3 | | 44.5 | 18.8 | 1.95 | 5.48 | 12.1 | 0.15 |
| Comp. Ex. 5 | 9.77 | 21.54 | 11.34 | 9.51 | 1.02 | 46.82 | 43.4 | 0.2 | 0.45 | 21.87 | 0.1 |
| Comp. Ex. 6 | 8.35 | 11 | 15.18 | 13.76 | | 51.71 | 39.9 | 0.2 | 0.76 | 28.94 | 0.05 |
| Comp. Ex. 7 | 0.56 | 31.14 | 10.73 | 4.12 | | 51.82 | 45.99 | 0.01 | 0.02 | 14.85 | less than 0.05 |

All of Inventive Examples 1 to 8 satisfy the relationship Al/(Cr+Ni+Si+Fe)≥2.0 in atomic % ratio. Furthermore, they satisfy the relationship Al/Cr≥10. On the other hand, Comparative Example 1 does not contain Al in the cast product, so that no aluminum oxide is formed and both Al/(Cr+Ni+Si+Fe) and Al/Cr are zero.

As for Comparative Examples 2-7, the relationship Al/(Cr+Ni+Si+Fe) is <2.0 and Al/Cr is <10. As for Comparative Example 7, it is noted that Al/(Cr+Ni+Si+Fe) is as small as about 0.01 and Al/Cr is also as small as about 0.02.

With regard to atomic percentages of Fe+Ni+Si, Inventive Examples 1-4, 6, and 7 and Comparative Example 3 are 10 atomic % or less, while other Inventive and Comparative Examples are more than 10 atomic %.

The ratio of the thickness of the second oxide layer to the thickness of the barrier layer was measured for Inventive Examples 1-8 and Comparative Examples 1-7. The results are shown in Table 3.

With reference to the ratio of the thickness of the second oxide layer to the thickness of the barrier layer in Table 3, all of Inventive Examples for are at least 0.3, i.e., one fifth (⅕), while Comparative Examples are, at most, 0.15. Comparative Example 1 does not contain Al and has no barrier layer. For Comparative Example 7, the first oxide layer was formed, but the second oxide layer was so thin that its thickness could not be measured, or it was not formed. Thus, Comparative Example 7 did not satisfy the relationship of Al/(Cr+Ni+Si+Fe)≥2.0.

The Inventive Examples were conducted at a temperature lower than 1050° C. in the first stage heat treatment and at a temperature of 1050° C. or higher in the second stage heat treatment, resulting in that the first oxide layer was formed on the surface of the cast product during the first stage heat treatment and then the second oxide layer was formed in between the surface of the sample tube and the first oxide layer during the second stage heat treatment.

As mentioned above, Comparative Examples 2-6 were up to 0.15 with respect to the ratio of the thickness of the second oxide layer to the thickness of the barrier layer. The reasons for these results are thought as follows:

For Comparative Example 2, an amount of Al contained in the sample tube was as small as 0.9%, and was insufficient to form an Al oxide layer on the surface of the tube. For Comparative Example 3, the first stage heat treatment was conducted at a temperature of 1200° C. that is higher than the present invention, resulting in that oxides with Cr, Ni, Si, and Fe were formed before the aluminum oxide of γ or θ phase structure was produced. For Comparative Example 4, the first stage heat treatment was conducted at such a temperature of 500° C. that is lower than the present invention, resulting in that no aluminum oxide layer of γ or θ phase structure was formed. For Comparative Examples 5 and 6, the second stage heat treatment was conducted at a temperature of 1000° C. that is lower than the present invention, resulting in that during second stage heat treatment, an amount of oxygen for passing through the first oxide layer formed in the first stage heat treatment is small, and also that the low temperature did not provide an energy sufficient to combine Al with oxygen taken from the atmosphere.

As for Comparative Example 7, the second oxide layer was practically unmeasurable, as mentioned above. This result is thought in that the second stage heat treatment was performed in a water-vapor atmosphere instead of in an air atmosphere. Under the first stage heat treatment, the first oxide layer was formed even in a water-vapor atmosphere. However, under the second stage heat treatment, the amount of oxygen that passed through the first oxide layer was too small to combine with Al because there was little oxygen in the water vapor atmosphere. As such, Comparative Example 7 did not meet relationship where the thickness of the second oxide layer/the thickness of the barrier layer is one fifth (⅕) or larger.

Next, a coking test was performed on the sample tubes of Inventive Examples 1-8 and Comparative Examples 1-6.

The coking test was performed by placing the sample tubes in an electric furnace, supplying a hydrocarbon (ethane) to the sample tubes, and then heating them at a high temperature (955° C.) for a predetermined time (12 to 24 hours). After the test, the degrees of carburization of the inner surfaces of the sample tubes were compared, and the weight ratio of coke (carbon) deposited on the inner surface of each sample tube was measured. The results are shown in Table 4.

TABLE 4

| No. | Carburization resistance | Weight ratio of produced coke | Surface roughness (Ra) |
|---|---|---|---|
| Inv. Ex. 1 | Good | 0.4 | 0.13 |
| Inv. Ex. 2 | Fair | 0.6 | 5.51 |
| Inv. Ex. 3 | Good | 0.8 | 7.63 |
| Inv. Ex. 4 | Good | 0.6 | 1.53 |
| Inv. Ex. 5 | Fair | 1 | 11.7 |
| Inv. Ex. 6 | Good | 0.6 | 1.54 |
| Inv. Ex. 7 | Good | 0.7 | 2.02 |
| Inv. Ex. 8 | Good | 1.1 | 13.8 |
| Comp. Ex. 1 | Poor | 0.9 | 9.17 |
| Comp. Ex. 2 | Poor | 0.7 | 4.5 |
| Comp. Ex. 3 | Poor | 1.5 | 18.1 |
| Comp. Ex. 4 | Poor | 0.7 | 8.32 |
| Comp. Ex. 5 | Poor | 0.8 | 6.27 |
| Comp. Ex. 6 | Poor | 1.4 | 16.47 |

With reference to Table 4, all of Inventive Examples 1-8 had good resistance to carburization. On the other hand, all of Comparative Examples 1-6 were found that carburization was occurred on the inside of the sample tubes.

The excellence of Inventive Examples 1-8 in carburization resistance is owing to the barrier layer comprising second oxide layer of a phase (corundum structure) and first oxide layer of a phase (corundum structure). In particular, Inventive Examples 1, 3, 4, and 6-8 had much superior carburization resistance compared with the other Inventive Examples such as Inventive Examples 2 and 5. This result is thought to be the indifference of the thickness of the second oxide layer. Concerning the ratio of the thickness of second oxide layer to the barrier layer, Inventive Examples 2 and 5 had 0.3 and 0.4, while other Inventive Examples had 0.5 or larger, as shown in Table 4.

In addition, the surface roughness (Ra) of each sample tube was measured. Table 4 shows the results as well. Table 4 shows that the weight ratio of the produced coke and the surface roughness (Ra) were substantially in proportion to each other. Accordingly, the surface roughness (Ra) is preferably 15 μm or less, and more preferably 10 μm or less.

The surface roughness (Ra) can be adjusted by performing the heat treatment while rotating the cast product. The surface roughness of Comparative Examples 3 and 6 exceeded 15 μm. This result is thought in that the heat treatment for forming the Al-containing metal oxide layer was not properly performed and the surface roughness was increased due to the peeling and restoration of the layer.

Example 2

With regard to Inventive Examples 2 and 7, the barrier layers were observed using a transmission electron microscope (TEM), and the first oxide layer and the second oxide layer were analyzed using the EDX. Similarly, for Comparative Example 7, the barrier layer was observed using scanning electron microscope (SEM) and was analyzed using the EDX. The results are shown in FIG. 4 for Inventive Example 2, in FIG. 5 for Inventive Example 7, and in FIG. 6 for Comparative Example 7.

Figure 4:
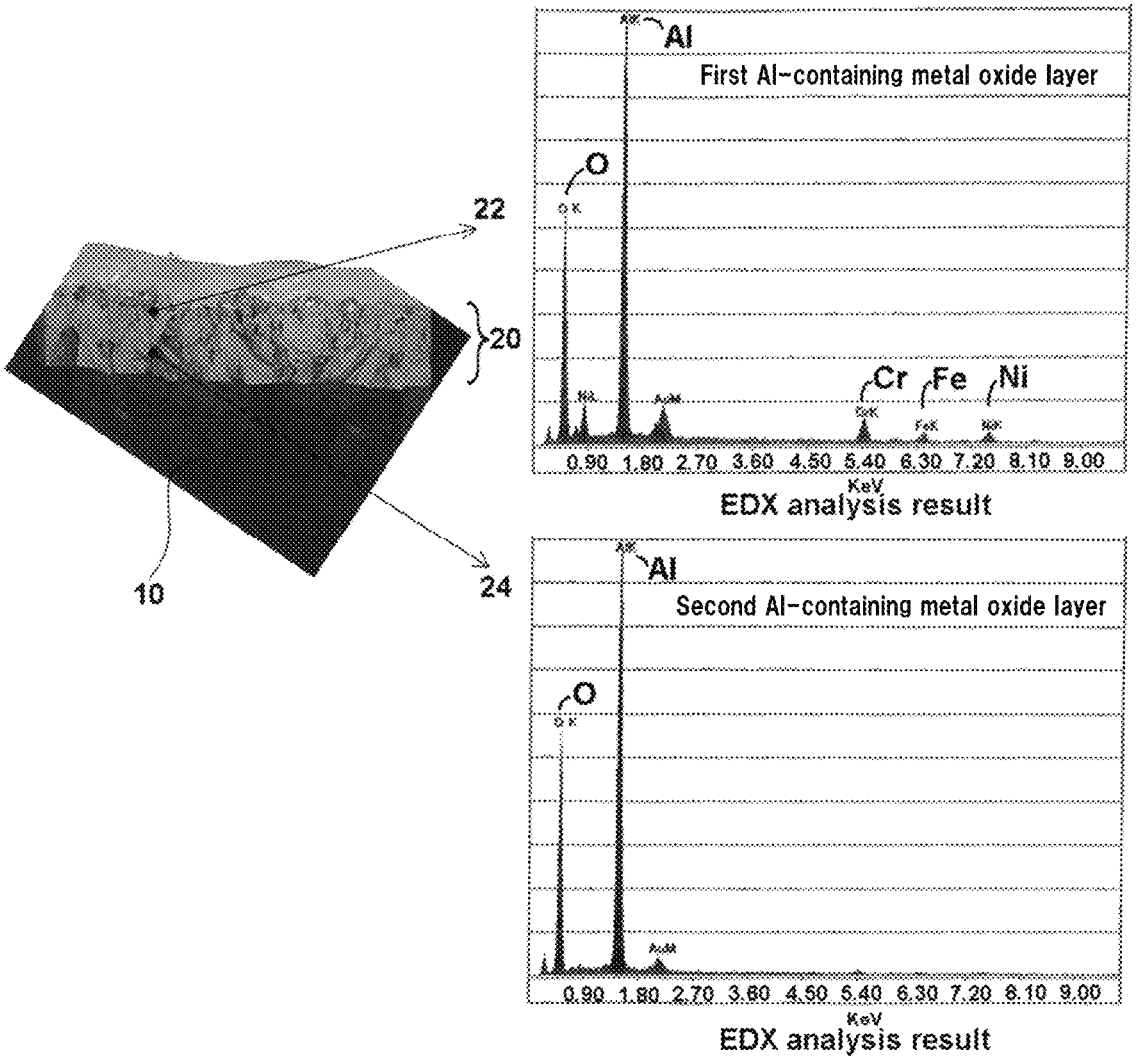
FIG. 4 shows a TEM photograph of an oxide layer of Inventive Example 2 and graphs illustrating the results of an EDX analysis.

With regard to Inventive Example 2, the first oxide layer 22 formed on the surface side comprises an oxide of Al as main component and a small amount of Cr, Fe, and Ni, as shown in FIG. 4. On the other hand, in the second oxide layer 24, only Al was observed and Cr, Fe, and Ni were not observed. Accordingly, the second oxide layer 24 is considered to be made of aluminum oxide with a very high purity.

Figure 5:
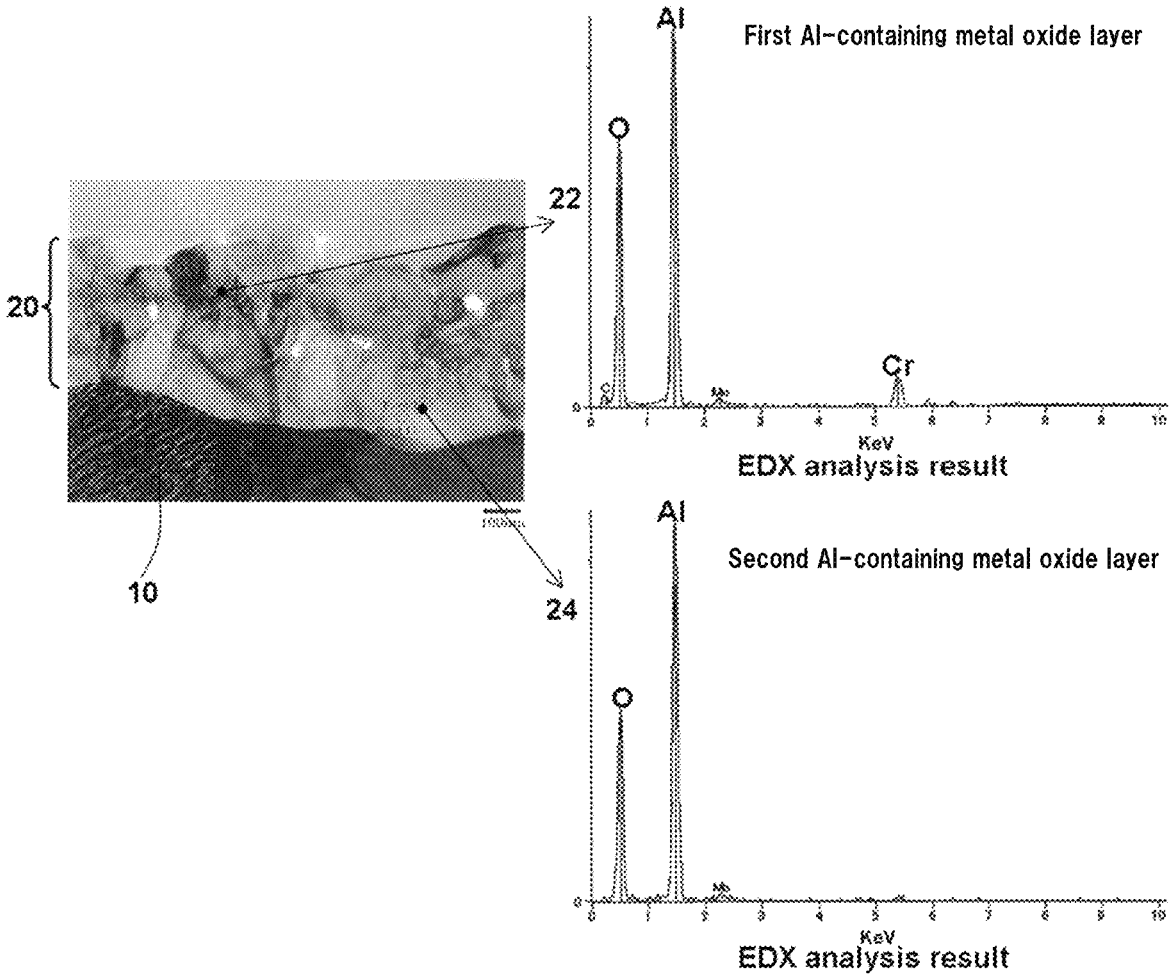
FIG. 5 shows a TEM photograph of an oxide layer of Inventive Example 7 and graphs illustrating the results of an EDX analysis.
Figure 6:
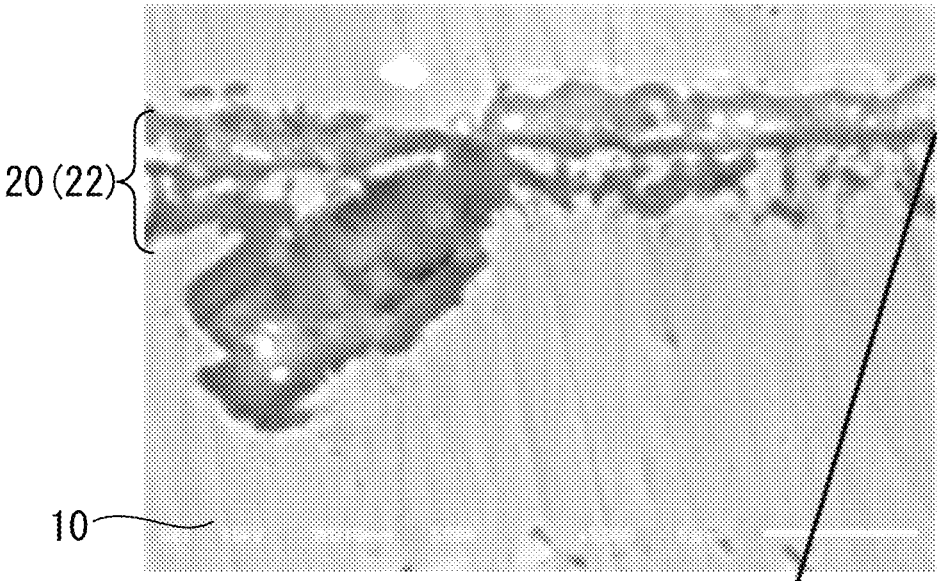
FIG. 6 shows a SEM photograph of an oxide layer of Comparative Example 7 and graphs illustrating the results of an EDX analysis.
Figure 6:
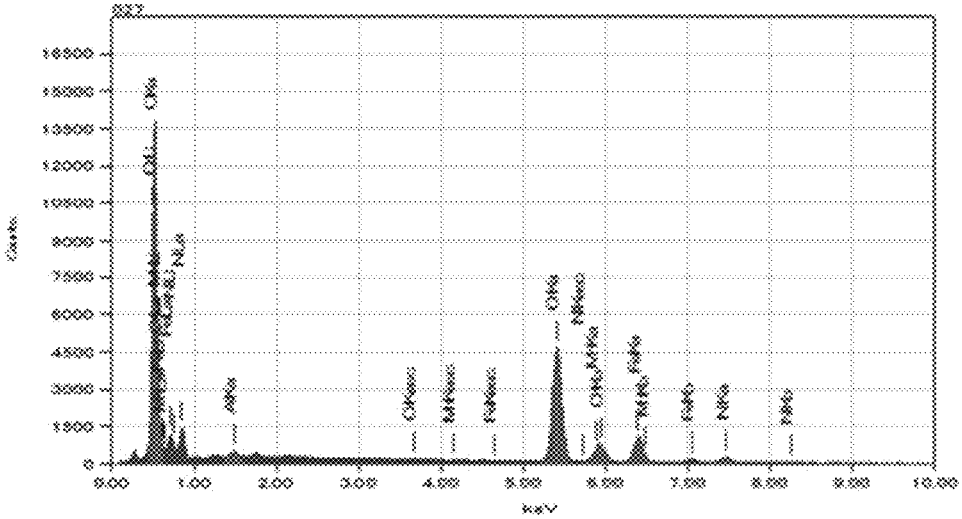

With regard to Inventive Example 7, the first oxide layer 22 formed on the surface side comprises an oxide of Al as main component and a small amount of Cr, as shown in FIG. 5. On the other hand, in the second oxide layer 24, only Al was observed, and Cr, Fe, and Ni were not observed. Accordingly, the second oxide layer 24 is considered to be made of aluminum oxide with a very high purity.

Referring to FIG. 7, Comparative Example 7 has a barrier layer 20 with a thickness of 4-10 microns, but most of the barrier layer 20 consists of the first oxide layer 22, and the second oxide layer was not observed.

Comparison of Inventive Examples 2 and 7 with Comparison Example 7 indicates that according to Inventive Examples, the Al-containing metal oxide in the barrier layer comprises a solid solution of at least one of Cr, Ni, Si, and Fe with Al, in a relationship of Al/(Cr+Ni+Si+Fe)≥2.0 in an atomic % ratio, and the barrier layer comprises a first oxide layer and a second oxide layer formed in between the surface of the tube and the first oxide layer, wherein the second oxide layer is greater than the first oxide layer with respect to the atomic % ratio of Al/(Cr+Ni+Si+Fe), and the second oxide layer has a thickness that is at least one fifth of a thickness of the barrier layer.

On the other hand, Comparative Example 7 does not meet the relationship of Al/(Cr+Ni+Si+Fe)≥2.0 and also the feature of ⅕ for the ratio of the thickness of the second oxide layer to the thickness of the barrier layer.

This difference is thought in that Inventive Examples performed the two-step heat treatment in air atmosphere including oxygen about 21 vol. % and nitrogen about 78 vol. %, while Comparative Example 7 performed the two-step heat treatment in water-vapor atmosphere including 60 mole % water vapor and 40 mole % nitrogen.

What is claimed is:

1. A cast product having a barrier layer formed on a surface of the cast product, the barrier layer comprising an Al-containing metal oxide expressed in $(Al_{(1-x)}M_{(x)})_2O_3$, where M is at least one of Cr, Ni, Si, and Fe, wherein the Al-containing metal oxide includes a solid solution of at least one of Cr, Ni, Si, and Fe with Al, in a relationship of Al/(Cr+Ni+Si+Fe)≥2.0 in an atomic % ratio, the barrier layer being composed of two layers consisting of a first Al-containing metal oxide layer and a second Al-containing metal oxide layer between the surface of the cast product and the first Al-containing metal oxide layer, wherein the second Al-containing metal oxide layer is greater than the first Al-containing metal oxide layer with respect to the atomic % ratio of Al/(Cr+Ni+Si+Fe), and the second Al-containing metal oxide layer has a thickness that is at least one fifth of a thickness of the barrier layer, where the cast product is made of a heat-resistant alloy consisting essentially of, in terms of mass %, C in an amount of 0.05 to 0.7%, Si in an amount of more than 0% to 2.5%, Mn in an amount of more than 0% to 3.0%, Cr in an amount of 15.0 to 50.0%, Ni in an amount of 18.0 to 70.0%, Al in an amount of 1.0 to 5.0%, rare earth elements in an amount of 0.005 to 0.4%, at least one of W in an amount of 0.5 to 10.0% and Mo in an amount of 0.1 to 5.0%, the balance being Fe and inevitable impurities.

2. The cast product according to claim 1, wherein the Al-containing metal oxide has a crystal structure and at least 80 vol. % thereof is corundum structure.

3. The cast product according to claim 1, wherein the solid solution includes at least Cr with Al, in a relationship of Al/Cr≥10 in an atomic % ratio.

4. The cast product according to claim 1, wherein the solid solution includes at least one of Ni, Si, and Fe with Al, the at least one of Ni, Si, and Fe having a total amount of up to 10 atomic %.

5. The cast product according to claim 1, wherein the barrier layer has a surface roughness (Ra) of 15 μm or less.

6. The cast product according to claim 1, wherein the heat-resistant alloy further contains, in terms of mass %, at least one selected from the group consisting of Ti in an amount of 0.01 to 0.6%, Zr in an amount of 0.01 to 0.6%, and Nb in an amount of 0.1 to 1.8%.

7. The cast product according to claim 1, wherein the heat-resistant alloy further contains, in terms of mass %, B in an amount of more than 0% to 0.1%.

8. The cast product according to claim 7, wherein the heat-resistant alloy further contains, in terms of mass %, B in an amount of more than 0% to 0.1%.

9. A reaction tube made of the cast product according to claim 1, the reaction tube being used for producing ethylene by passing hydrocarbon feedstock gas along the inner surface of the tube, wherein the inner surface of the tube has the barrier layer comprising the Al-containing metal oxide.

10. The cast product according to claim 1, wherein the heat-resistant alloy is an austenite-based alloy.

* * * * *